US011965299B2

(12) United States Patent
Jiang

(10) Patent No.: US 11,965,299 B2
(45) **Date of Patent: *Apr. 23, 2024**

(54) DOG WASTE REMOVAL APPARATUS

(71) Applicant: Peigen Jiang, Sammamish, WA (US)

(72) Inventor: Peigen Jiang, Sammamish, WA (US)

( * ) Notice: Subject to any disclaimer, the term of this patent is extended or adjusted under 35 U.S.C. 154(b) by 154 days.

This patent is subject to a terminal disclaimer.

(21) Appl. No.: 17/203,752

(22) Filed: Mar. 17, 2021

(65) Prior Publication Data

US 2022/0298735 A1 Sep. 22, 2022

(51) Int. Cl.
*E01H 1/12* (2006.01)
*E01H 1/00* (2006.01)

(52) U.S. Cl.
CPC ..... *E01H 1/1206* (2013.01); *E01H 1/006* (2013.01); *E01H 2001/126* (2013.01)

(58) Field of Classification Search
CPC .. E01H 1/1206; E01H 1/006; E01H 2001/126
See application file for complete search history.

(56) References Cited

U.S. PATENT DOCUMENTS 3,857,597 A * 12/1974 Young ..... E01H 1/1206 294/1.3
4,747,633 A * 5/1988 Stacy ..... E01H 1/1206 294/1.3
5,964,488 A * 10/1999 Bedel ..... E01H 1/1206 294/1.3
8,403,386 B2 * 3/2013 Hoffman ..... E01H 1/1206 294/1.3
10,487,466 B1 * 11/2019 Belter ..... E01H 1/1206
2004/0222650 A1 * 11/2004 Colesanti ..... E01H 1/1206 294/1.3
2011/0289024 A1 * 11/2011 Chongtoua ..... A01K 1/0125 229/5.5

* cited by examiner

*Primary Examiner* — Stephen A Vu

(57) ABSTRACT

An apparatus for removing dog waste is disclosed which includes a bottom panel (235) for scooping up a piece of dog waste from a ground, a left side panel (122L) and a right side panel (122R) both attached to a back panel (223), each of the left side panel (122L), the right side panel (122R) and the back panel (223) also attached to the bottom panel (235) to form a concave space with only one front opening, and a front panel (102) pivotally connected to a top edge of the back panel (223), wherein when the front panel (102) pivots to a first position the front panel (102) reaches the bottom panel (235) and completely covers the front opening, and when the front panel (102) pivots to a second position there is a gap between the front panel (102) and the bottom panel (235) for accommodating the piece of dog waste.

17 Claims, 3 Drawing Sheets

DOG WASTE REMOVAL APPARATUS

BACKGROUND

The present disclosure relates generally to dog waste or other excrement removal apparatus, and, more particularly, to a disposable dog waste removal box.

Many people keep dogs as pets for companionship and protection. However, like any living creature, dogs excrete waste, and unlike cats, they do so in random places, thus removing dog waste is a nuance for many dog owners.

Conventionally, plastic bags are used to remove do waste. But plastic bags not only create environmental damage but also require people to use their hands to pick up dog waste, which is of course a bit disgusting. To avoid the hand picking up, some mechanical scoopers were developed. However, such scoopers are generally bulky and themselves require cleaning after each use.

As such, what is desired is a clean, easy to carry and environmental-friendly dog waste removal apparatus.

SUMMARY

An apparatus for removing dog waste is disclosed which includes a bottom panel for scooping up a piece of dog waste from a ground, a left side panel and a right side panel both attached to a back panel, each of the left side panel, the right side panel and the back panel also attached to the bottom panel to form a concave space with only one front opening, and a front panel pivotally connected to a top edge of the back panel, wherein when the front panel pivots to a first position the front panel reaches the bottom panel and completely covers the front opening, and when the front panel pivots to a second position there is a gap between the front panel and the bottom panel for accommodating the piece of dog waste.

Figure 1:
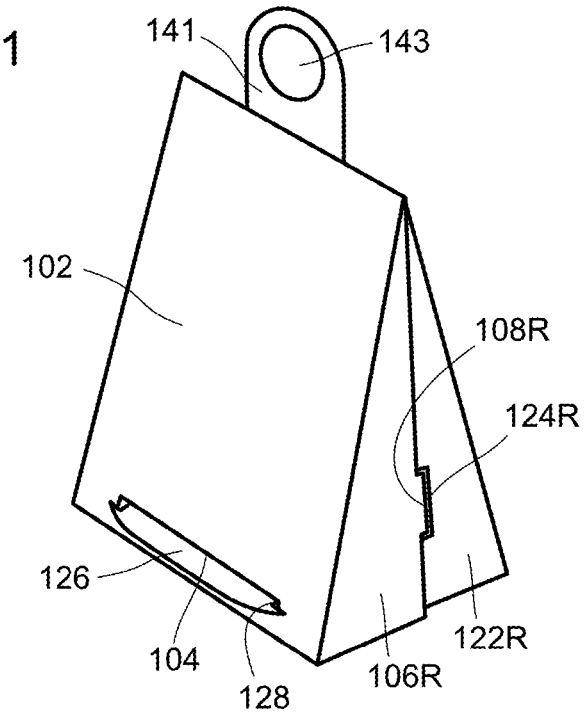
FIG. 1 is a perspective view of a closed dog waste removal box according to an embodiment of the present disclosure.

The drawings accompanying and forming part of this specification are included to depict certain aspects of the disclosure. A clearer conception of the disclosure, and of the components and operation of systems provided with the disclosure, will become more readily apparent by referring to the exemplary, and therefore non-limiting, embodiments illustrated in the drawings, wherein like reference numbers (if they occur in more than one view) designate the same elements. The disclosure may be better understood by reference to one or more of these drawings in combination with the description presented herein.

DESCRIPTION

The present disclosure relates to a dog waste removal apparatus. A preferred embodiment of the present disclosure will be described hereinafter with reference to the attached drawings.

FIG. 1 is a perspective view of a closed dog waste removal box according to an embodiment of the present disclosure. The dog waste removal box includes a front panel 102 with a foldable right side flap 106R engaging a right side panel 122R by being folded perpendicular to the front panel 102. A right side tab 108R protruding from the right side flap 106R is inserted into a right side slot 124R on the right side panel 122R. The dog waste removal box further includes a bottom panel (not shown) with an exemplary protruding front tab 126 to engage the front panel 102 by inserting through a front slot 104 near a lower edge of the front panel 102. In an embodiment, the front tab 126 has a wider front portion and a narrow neck portion 128. The front portion is slightly wider than a width of the front slot 104, and the neck portion 128 is slightly narrower than the width of the front slot 104. As, in an embodiment, the aforementioned panels and tabs are made of a thin flexible card paper, the front portion of the front tab 126 can be pushed through the front slot 104 and lock the front slot 104 in the neck portion 128.

Referring to FIG. 1 again, the dog waste removal box has a triangle shape in a side view and rectangular shape in a back and front view. The dog waste removal box further includes a handle 141 attached to a back panel (not shown) of the dog waste removal box. The handle 141 has a round opening 143 to accommodate a finger. In an embodiment, the handle 141 is made of a paper material thicker than that of the panels' card paper to prevent paper cuts to the finger and is glued to the back panel.

Figure 2:
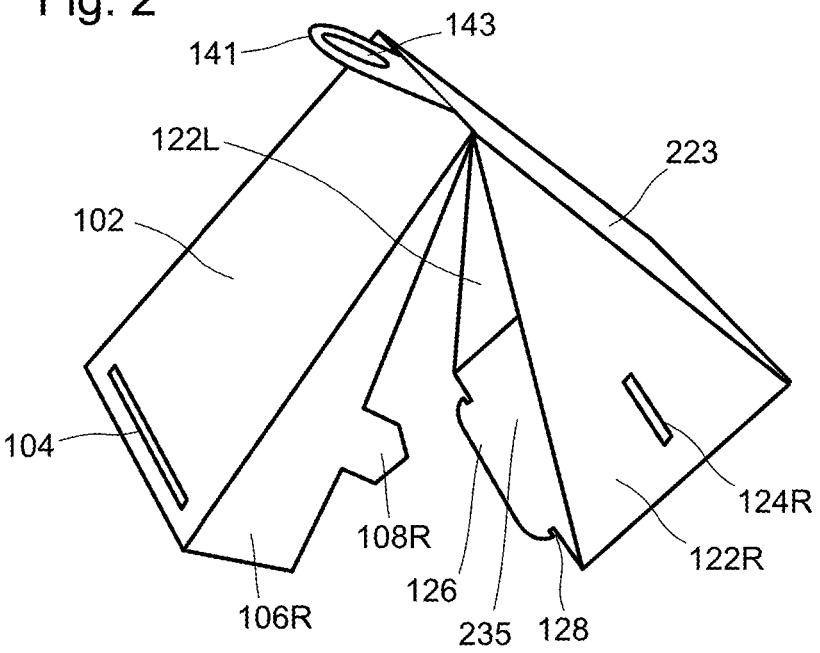
FIG. 2 is a perspective view of the dog waste removal box of FIG. 1 in an open state.

FIG. 2 is a perspective view of the dog waste removal box of FIG. 1 in an open position in which the front panel 102 swings open to leave a gap between the front panel 102 and the bottom panel 235. In an embodiment, the front panel 102 and a back panel 223 are made of one sheet of card paper which is die cut into predetermined size and shape and folded to form the front panel 102 and the back panel 223 and can be folded at different angles. In operation, a piece of dog waste locates on a ground in the gap. A user uses one hand to stop the front panel 102 and another hand to push the bottom panel 235 to scrape the ground and scoop up the piece of dog waste onto the bottom panel 235. With the piece of dog waste being scooped up, the front panel 102 will be pushed against the bottom panel 235. A length of the front panel 102 is designed so that the front tab 126 is aligned to the front slot 104 when the front panel 102 is pushed toward the bottom panel 235, the front tab 126 is straightly inserted into the slot 104. With the wider front portion and the narrower neck portion 128, the front tab 126 locks the front panel 102 to the bottom panel 235.

Referring the FIG. 2 again, the right side panel 122R is of triangle shape, and so is the right side flap 106R albeit the latter is narrower in the bottom than the former, so that the protruding right side tab 108R can be inserted in the right side slot 124R.

In an embodiment, the side panels 122R and 122L is an isosceles triangle with a length of the sides being at least twice as long as a length of the bottom. Such design allows the bottom panel 235 keep a small angle to the ground while the front panel 102 is opened enough and touching the ground to accommodate a piece of dog waste.

Figure 3:
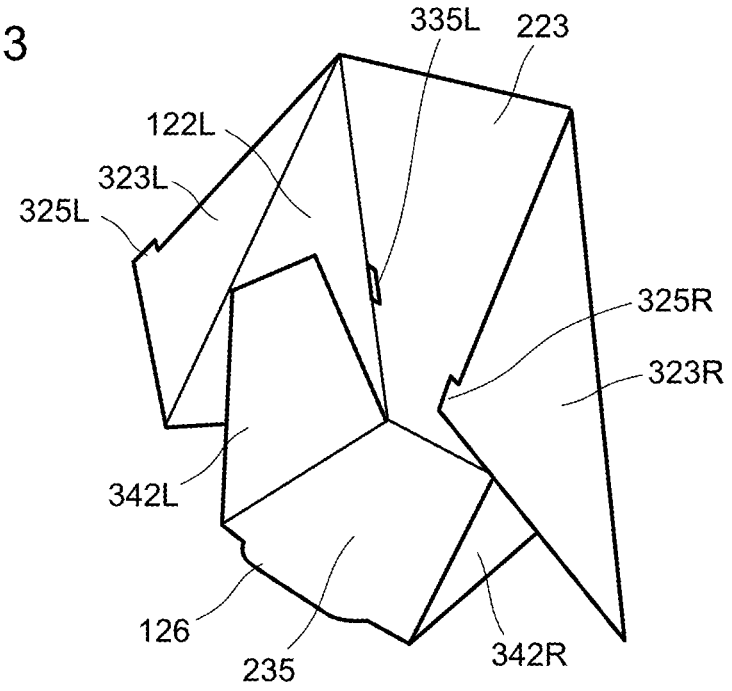
FIG. 3 is a perspective view of the side, the back, and the bottom panels of the dog waste removal box of FIG. 1.

FIG. 3 is a perspective view of the left side panel 122L, the back panel 223 and the bottom panel 235 of the dog waste removal box of FIG. 1. In an embodiment, the back panel 223 and the bottom panel 235 are made of one sheet of card paper folded into the two panels. The bottom panel 235 has a left fold-up member 342L and a right fold-up member 342R which are symmetrical and of the same trapezoidal shape. The left side panel 122L and the back panel 223 are also made of the same sheet of card paper folded into the back panel 223 and the two substantially symmetrical side panels 122L and 122R (shown in FIGS. 1 and 2). The side panels 122L and 122R are of triangle shape. The left side panels 122L has a left foldable side member 323L with a protruding left back tab 325L. The right side panel 122R has a foldable right side member 323R with a protruding right back tab 325R. When in use, the left foldable side member 323L is folded to substantially overlap a lower portion of the left side panel 122L with the left back tab 325L inserted in a left back slot 335L on a left edge of the back panel 223 sandwiching the left fold-up member 342L. Similarly, the right foldable side member 323R is folded to substantially overlap a lower portion of right side panel 122R with the right back tab 325R inserted in a right back slot 335R (not shown) on a right edge of the back panel 223 sandwiching the right fold-up member 342R. In an embodiment, the left fold-up member 342L is sized to snuggly fit into a contour of the left side panel 122L, and the right fold-up member 342R is sized to snuggly fit into a contour of the right side panel 122R, so that the bottom panel 235 is unmovably secured to the side panels 122L and 122R.

Figure 4:
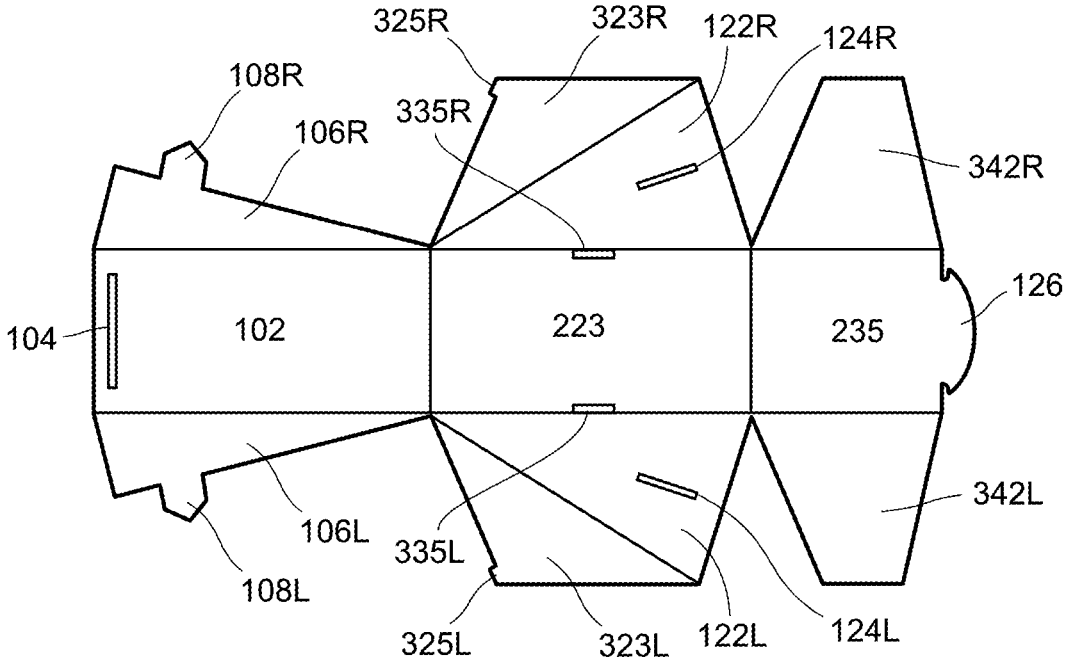
FIG. 4 is a top view of a flattened dog waste removal box of FIG. 1.

FIG. 4 is a top view of a flattened dog waste removal box of FIG. 1. The dog waste removal box is made of one sheet of card paper die cut into aforementioned parts with folding lines. The bottom panel 235, the back panel 223 and the front panel 102 are of substantially the same width. The left and right structural members are substantially symmetrical. For instance, the right side flap 106R is symmetrical to the left side flap 106L; the right side panel 122R is symmetrical to the left side panel 122L; and the right fold-up member 342R is symmetrical to the left fold-up member 342L.

Figure 5:
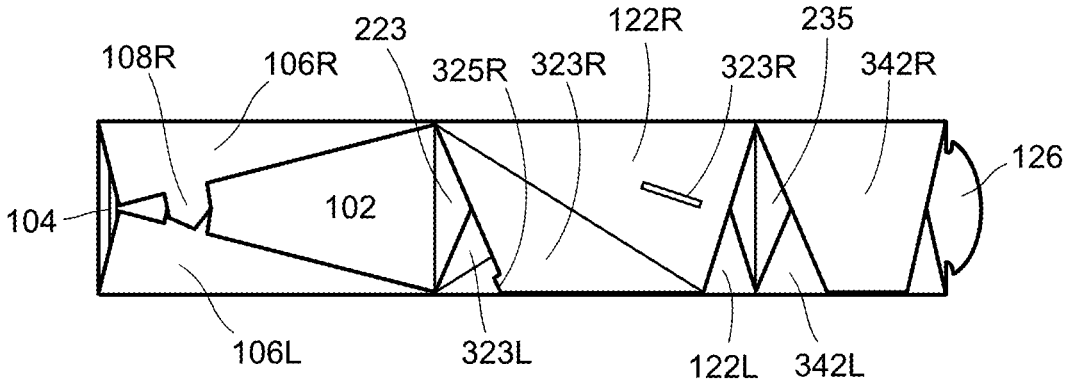
FIG. 5 is a top view of a flat folded dog waste removal box of FIG. 1.

FIG. 5 is a top view of a flat folded dog waste removal box of FIG. 1. The side flaps 106L and 106R are narrower than the width of the front panel 102 and are folded onto the front panel 102. The side panels 122L and 122R along with respective foldable side members 323L and 323R are narrower than the width of back panel 223 and are folded onto the back panel 223. The fold-up members 342L and 342R are narrower than bottom panel 235 and are folded onto the bottom panel 235.

Figure 6:
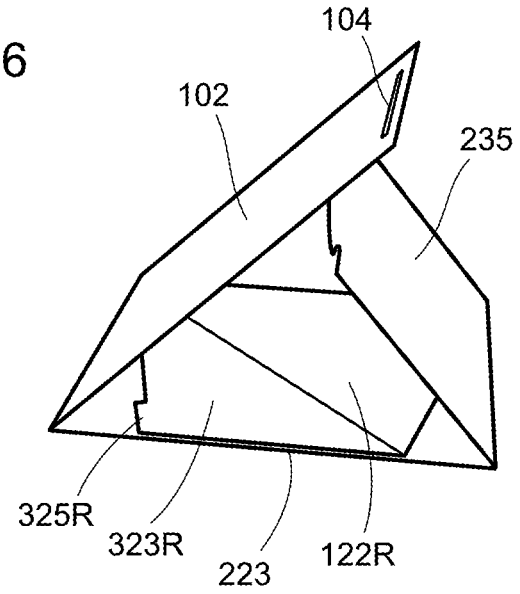
FIG. 6 is a perspective view of a further flat folded dog waste removal box of FIG. 1.

FIG. 6 is a perspective view of a further flat folded dog waste removal box of FIG. 1 for transportation. The bottom panel 235 is exemplarily less than half as long as the back panel 223, so that the bottom panel 235 can be folded onto the back panel 223. Then the front panel 102 is folded onto the bottom panel 235, so that the folded dog waste removal box has a small, flattened dimension for transportation. As described in FIGS. 1-3, the dog waste removal box can be easily folded up at a time of use to form a hollow box with an opening to scoop up a piece of dog waste.

Although the disclosure is illustrated and described herein as embodied in one or more specific examples, it is nevertheless not intended to be limited to the details shown, since various modifications and structural changes may be made therein without departing from the spirit of the disclosure and within the scope and range of equivalents of the claims. Accordingly, it is appropriate that the appended claims be construed broadly and in a manner consistent with the scope of the disclosure, as set forth in the following claims.

What is claimed is:

1. An apparatus for removing dog waste, the apparatus comprising:

a bottom panel (235) for scooping up a piece of dog waste from a ground;

a left side panel (122L) and a right side panel (122R) both attached to a back panel (223), each of the left side panel (122L), the right side panel (122R) and the back panel (223) also attached to the bottom panel (235) to form a concave space with only one front opening;

a right fold-up member (342R) connected to the bottom panel (235) and sandwiched between the right side panel (122R) and a right foldable side member (323R) wherein the right foldable side member (323R) is connected to a first edge of the ride side panel (122R) while the back panel (223) is connected to a second edge of the ride side panel (122R), and the first edge and the second edge are on opposite sides of the ride side panel (122R); and a front panel (102) pivotally connected to a top edge of the back panel (223), wherein when the front panel (102) pivots to a first position the front panel (102) reaches the bottom panel (235) and completely covers the front opening, and when the front panel (102) pivots to a second position there is a gap between the front panel (102) and the bottom panel (235) for accommodating the piece of dog waste.

2. The apparatus of claim 1, wherein the right foldable side member (323R) has a protruding right back tab (325R) inserted in a right back slot (335R) formed along a lateral edge of the back panel (223).

3. The apparatus of claim 1, wherein the left side panel (122L) and a right side panel (122R) are of triangular shape.

4. The apparatus of claim 1, wherein the bottom panel (235), the back panel (223) and the front panel (102) are of rectangular shape.

5. The apparatus of claim 1, wherein the bottom panel (235) includes a protruding front tab (126) engaging a front slot (104) on the front panel (102) when the front panel (102) is in the first position.

6. The apparatus of claim 5, wherein the front tab (126) has a front portion with a width wider than a width of the front slot (104) and a neck portion (128) with a width narrower than the width of the front slot (104).

7. The apparatus of claim 1, wherein the front panel (102) includes a right side tab (108R) inserted in a right side slot (124R) formed on the right side panel (122R) when the front panel (102) is at the first position.

8. The apparatus of claim 7, wherein the front panel (102) includes a right side flap (106R) folded to overlay a part of the right side panel (122R) when the front panel (102) is at the first position and the right side tab (108R) protrudes from a lateral edge of the right side flap (106R).

9. The apparatus of claim 1, wherein the bottom panel (235), the left side panel (122L), the right side panel (122R), the back panel (223), and the front panel (102) are formed by a card paper sheet die cut into predetermined shapes.

10. The apparatus of claim 1 further comprising a handle (141) attached to a top portion of the back panel (223).

11. The apparatus of claim 10, wherein the handle (141) includes an opening to accommodate a finger.

12. An apparatus for removing dog waste, the apparatus comprising:

a bottom panel (235) for scooping up a piece of dog waste from a ground;

a left side panel (122L) and a right side panel (122R) both of triangle shape and each having a side edge connected to a long edge of a rectangular-shaped back panel (223), each of the left side panel (122L), the right side panel (122R) and the back panel (223) being attached to the bottom panel (235) to form a four-sided concave space with only one front opening; and a front panel (102) pivotally connected to a short edge of the rectangular-shaped back panel (223), wherein when the front panel (102) pivots to a first position the front panel (102) reaches the bottom panel (235) and completely covers the front opening, and when the front panel (102) pivots to a second position there is a gap between the front panel (102) and the bottom panel (235) for accommodating the piece of dog waste.

13. The apparatus of claim 12 further comprising a right fold-up member (342R) connected to the bottom panel (235) and sandwiched between the right side panel (122R) and a right foldable side member (323R), wherein the right fold-up member (342R) is of trapezoidal shape substantially overlapping a lower part of the right side panel (122R).

14. The apparatus of claim 13, wherein the right foldable side member (323R) includes a protruding right back tab (325R) inserted in a right back slot (335R) formed along the long edge of the back panel (223).

15. The apparatus of claim 12, wherein the bottom panel (235) includes a protruding front tab (126) engaging a front slot (104) on the front panel (102) when the front panel (102) is in the first position, wherein the front tab (126) has a front portion with a width wider than a width of the front slot (104) and a neck portion (128) with a width narrower than the width of the front slot (104).

16. A card paper sheet for being folded into a box for removing dog waste, the card paper sheet comprising:

a first rectangular section (235) with a front tab (126) protruding from a first edge thereof, the first rectangular section (235) serving as a bottom panel for the box;

a symmetrical pair of fold-up members (342L and 342R) flanking the first rectangular section (235) at a second and a third edge thereof, respectively;

a second rectangular section (223) juxtaposing the first rectangular section (235) and serving as a back panel of the box;

a symmetrical pair of side panels (122L and 122R) flanking the second rectangular section (223) serving as side panels of the box;

a third rectangular section (102) juxtaposing the second rectangular section (223) and serving as a front panel of the box, the third rectangular section (102) having a front slot (104) for engaging the front tab (126) when folded into the box; and a symmetrical pair of side tabs (108L and 108R) flanking the third rectangular section (102) for engaging a pair of side slots (124L and 124R) formed on the pair of side panels (122L and 122R), respectively.

17. The card paper sheet of claim 16 further comprising a pair of foldable side member (323L and 323R) flanking the pair of side panels (122L and 122R), respectively, for being folded onto the pair of side panels (122L and 122R), respectively, sandwiching the pair of fold-up members (342L and 342R), respectively, when forming the box.

* * * * *